United States Patent [19]

Ngo

[11] 4,009,415

[45] Feb. 22, 1977

[54] PLASMA PANEL WITH DYNAMIC KEEP-ALIVE OPERATION UTILIZING A LAGGING SUSTAIN SIGNAL

[75] Inventor: Peter Dinh-Tuan Ngo, Colts Neck, N.J.

[73] Assignee: Bell Telephone Laboratories, Incorporated, Murray Hill, N.J.

[22] Filed: Nov. 24, 1975

[21] Appl. No.: 634,373

[52] U.S. Cl. ..... 315/169 TV; 315/169 R; 340/324 M

[51] Int. Cl.[2] ..... H05B 41/14

[58] Field of Search ..... 315/169, 169 R, 169 TV, 315/171; 340/324 R, 324 M, 166 R, 166 PL; 178/7.3 D

[56] References Cited

UNITED STATES PATENTS

| | | | |
|---|---|---|---|
| 3,654,507 | 4/1972 | Caras et al. | 315/169 TV |
| 3,733,435 | 5/1973 | Chodil et al. | 315/169 TV |
| 3,742,483 | 6/1973 | Ogle | 315/169 TV |
| 3,761,773 | 9/1973 | Johnson et al. | 315/169 TV |
| 3,786,484 | 1/1974 | Miavecz | 340/324 R |
| 3,800,296 | 3/1974 | Weber | 178/7.3 D |
| 3,801,864 | 4/1974 | Yamane et al. | 178/7.3 D |
| 3,839,713 | 10/1974 | Urade et al. | 178/7.3 D |

*Primary Examiner*—Eugene R. La Roche
*Attorney, Agent, or Firm*—William Ryan; Ronald D. Slusky

[57] ABSTRACT

An a-c plasma display panel including apparatus for driving the keep-alive cell sustain signal circuits in a non-fixed relation with address pulses. By constraining the keep-alive sustain signal to selectively lag the addressing signal by an amount dependent on the address of a cell being addressed it is possible to refine the control over voltage margins afforded by dynamic keep-alive while simplifying the circuitry required to produce it.

10 Claims, 12 Drawing Figures

FIG. 12

| | 3msb | 3msb INVERTED | τ | |
|---|---|---|---|---|
| 0 | 000 | | τ = -3ΔT | FIRST HALF |
| X | 001 | | τ = -2ΔT | |
| | 010 | | τ = -ΔT | |
| | 011 | | τ = 0 | |
| | 100 | 011 | τ = 0 | SECOND HALF |
| | 101 | 010 | τ = -ΔT | |
| | 110 | 001 | τ = -2ΔT | |
| | 111 | 000 | τ = -3ΔT | |

PLASMA PANEL WITH DYNAMIC KEEP-ALIVE OPERATION UTILIZING A LAGGING SUSTAIN SIGNAL

BACKGROUND OF THE INVENTION

1. Field of the Invention

The present invention relates to plasma display panels. More particularly, the present invention relates to plasma display panels of the matrix variety containing a plurality of individual display cells defined by the intersection of substantially orthogonal sets of conductors. Still more particularly, the present invention relates to such matrix plasma panels employing so-called "keep-alive" cells disposed around the periphery of the matrix proper for purposes of facilitating the breakdown of the gas at an addressed cell by increasing the density of photons, photo electrons and ions at that cell.

2. Description of the Prior Art

In U.S. Pat. No. 3,559,190 issued Jan. 26, 1971, to D. L. Bitzer et al, there is disclosed a gaseous display and memory system which may be characterized as being of the pulsing discharge type having a gaseous medium, usually a mixture of two gases at a relatively high pressure, in a thin gas chamber or space between opposed dielectric charge storage members which are backed by conductor arrays. The conductor arrays backing each dielectric member are typically arranged in overlapping orthogonal manner to define a plurality of discrete discharge volumes or cells. The discharge units in the Bitzer et al system are additionally defined by a perforated plate interposed between the two dielectric members with the perforations being aligned at points where the overlapping of the conductor arrays occur. In U.S. Pat. No. 3,499,167 issued Mar. 3, 1970 to Baker et al, a similar system is disclosed. Because of other system parameters, it is possible to eliminate in the Baker et al system the physical barriers provided by the perforated member.

In any event, in plasma panels of this general type operation is based on the fact that a conducting plasma of electrons and positive ions is produced upon ionization of the gas contained in the envelope of the panel. This occurs upon selection of a particular cell by applying appropriate operating potentials to a particular pair of crossed conductors, one from each of the orthogonally arranged arrays. When a cell is once selected by standard half select techniques and a gas discharge is effected at a particular selected cell, it is possible to maintain in future cycles the discharge at that cell with a somewhat lower operating voltage. Thus, though a particularly high voltage is necessary to write such a cell, it proves possible to sustain a discharge at subsequent times by repetitively applying an AC (sinusoidal or pulse) sustain signal having a magnitude lower than the write signal.

A description of typical commercially available AC plasma display system, is contained in Johnson and Schmersal, "A Quarter-Million-Element AC Plasma Display with Memory," Proc. of the S.I.D., Vol. 13, No. 1, First Quarter 1972, pp. 56–60. The panel described in the Johnson and Schmersal paper is manufactured by Owens-Illinois, Inc.

It is well known in the art that to facilitate the operation of cells disposed in a matrix fashion on a substantially planar panel, e.g., of the type described in the Johnson and Schmersal paper, the working atmosphere surrounding each cell is advantageously "enriched" by the presence of free ions, electrons or photons. It has proven advantageous in prior art systems to provide an initial source of such ions or photons integral with the panel itself, or to apply photons from an external source, e.g., from an ultraviolet light source. In providing a source of ions or photons by virtue of structure integral with the matrix display proper, it has proven useful to provide so-called "keep-alive" cells which have as their purpose to create the required ions or photons. Such keep-alive cells are described, for example, in U.S. Pat. No. 3,654,507 issued Apr. 4, 1972 to Caras and Ogle; and in Holz, "The Primed Gas Discharge Cell--A Cost and Capability Improvement for Gas Discharge Matrix Displays," Proc. of the S.I.D., Vol. 13, No. 1, First Quarter 1972, pp. 2–5.

The above-cited panel described in the Johnson and Schmersal paper advantageously utilizes such keep-alive cells as well; the panel described and manufactured by Owens-Illinois utilizes keep-alive cells positioned around the entire panel. In typical configuration, then, the band of cells, including four rows or columns of cells around the borders of the Owens-Illinois panel, are maintained in the "on" state to create the required radiation (photons or photo electrons, etc.). These border keep-alive cells are driven from a separate sustain source which is adjusted to synchronize with the display sustain signals unless some cell is to be addressed. When a cell is to be addressed, the keep-alive sustain signal temporarily resynchronizes with the addressing signal, typically preceding it by 1–2 $\mu$ sec instead of by the 6 $\mu$ sec it would if resynchronization did not take place.

It has been the experience of plasma panel designers, especially those desiring to build a panel of any substantial size, e.g. comprising a 512 × 512 matrix of cells, that there is a considerable variation in the threshold for signals to accomplish the writing of information. This variation is related, in part, to the position on the panel of a cell being selected. Thus, in particular, in the Owens-Illinois panels it has been a common experience that cells centrally located on the panel have, in general, a higher threshold for writing. This may be explained in part by the fact that such cells are especially remote from the border "keep-alive" cells, and therefore from a ready source of radiation, photoelectrons and other ions.

While uniformity in writing voltages alone is desirable, it should be understood that any lack in this regard is not a matter of mere inconvenience. Thus, if a write voltage level is selected which is unusually high, so that it is sure that it will be sufficient for all cells in a matrix array, care must be exercised that spurious operation of non-selected cells is avoided. Thus, in recognizing that one must require at least a minimum threshold value while not exceeding a maximum value (to avoid crosstalk), it is clear that there exists a range of acceptable values for the write signals in a plasma panel display. Because not all panels manufactured have identical physical characteristics, (e.g., spacing between dielectric planes, aging characteristics, and the like), it is required that some allowable variability of voltage for the write signals be present. Thus, there must be an operating range or margin for such write signals to account for variability in particular panel characteristics. In addition to panel-to-panel variations, it will be understood that cell-to-cell variations for a given panel will also occur.

It is therefore an object of the present invention to provide an apparatus and method for improving the uniformity of voltages required to write information into (or otherwise address) a selected cell in a plasma panel matrix while maximizing the addressing voltage margins for the panel.

A partial fulfillment of these objectives is achieved by the dynamic keep-alive scheme presented in my copending application, Ser. No. 460,757 filed Apr. 15, 1974, now U.S. Pat. No. 3,979,638 issued on Sept. 7, 1976. In a typical embodiment disclosed there, the leading edge of the keep-alive sustain pulse is stretched to precede the addressing signal by a time increment dependent on the distance between the addressed cell and the nearest keep-alive border. Thus cells which are spatially far removed from the keep-alive borders experience the effects of keep-alive priming almost simultaneously with the beginning of the addressing signals, while there is a considerable time lag between the priming and the addressing of cells close to the keep-alive borders. The net effect is to make a uniform effective quantity of priming radiation available to each cell at the time it is addressed, in general permitting more uniform operating voltages and wider operating margins over the panel.

However, the time lag necessary to produce uniform priming in even a moderate-sized display is often considerable, up to 6 $\mu$ sec in some 512 × 512 panels, for example. In addition, the considerably stretched keep-alive sustain pulse required may give rise to a number of problems which will later be explained in detail.

Further objects of this invention therefore include refining the control over operating margins afforded by dynamic keep-alive technique while minimizing the sustain pulse distortion necessary to produce these results.

SUMMARY OF THE INVENTION

In realizing the above and other objects to be detailed below, the present invention recognizes the fact that the timing of the emission of photoelectrons from the keep-alive cells is of considerable importance in determining the required write voltages at prescribed cells. The invention further recognizes the desirability of adjusting the relative values of the addressing signal and the keep-alive priming for a prescribed cell without introducing such large time lags into the process. Thus there is provided in accordance with one embodiment of the present invention apparatus for selectively delaying the application of sustain signals to the border keep-alive cells in a configuration like that described by Johnson and Schmersal in the above-cited paper. Keep-alive priming is advantageously delayed beyond the onset of the addressing signal in order to vary the effective duration of the addressing signal, thereby providing the desired adjustment in a shorter time period. The particular delays introduced in activating the sustain circuitry for the keep-alive cells is determined by the position (address) of a particular cell to be addressed.

In accordance with the typical embodiments described in the sequel, it has been found that operating margins may be increased by a considerable amount as compared with the system described in the Johnson and Schmersal paper. In addition, it has been found possible to reduce the time lag required between keep-alive and addressing signals, and to control the dynamic keep-alive effects more sharply than was possible through the invention of the above-cited Ngo application.

BRIEF DESCRIPTION OF THE DRAWING

These and other objects and features of the present invention will be described in connection with the attached drawing wherein.

DETAILED DESCRIPTION

Figure 1:
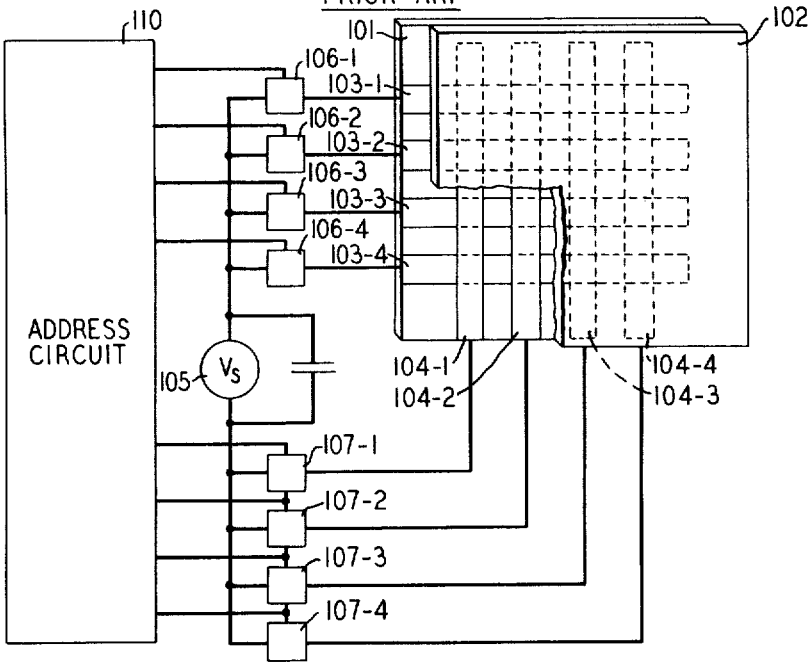
FIG. 1 PRIOR ART
FIG. 1 shows a prior art plasma panel including typical write-sustain electrical driving circuitry.

FIG. 1 shows a typical prior art plasma panel system. Thus there is shown a pair of spaced-apart dielectric layers 101 and 102 on which are laid respective pluralities of horizontal and vertical electrodes 103-i and **104-*j***, i,*j* = 1,2, . . . ,N. While N for the panel shown in FIG. 1 is only 4, it should be understood that in general N is a considerably larger number, e.g., 512, as in the panel described in the Johnson and Schmersal paper, supra. Also shown in FIG. 1 is a sustain drive source 105. Sustain source 105 is, of course, the standard sustain drive source for applying the sustain signals to the respective X and Y electrodes. Application of the sustain signals is by way of X drive circuits **106-*i* and Y drive circuits 107-*j***, i,*j* = 1,2, . . . ,N. Also applied to X and Y drive circuits **106-*i* and 107-*j* are signals emanating from address circuit 110. Address circuit 110 may, of course, be any standard addressing circuit capable of selecting individual X and Y electrodes. The addressing signals from circuit 110 are, of course, those appropriate when a write or an erase signal is to be applied to the cell defined by the intersection of a particular pair, or particular pairs, of electrodes 103-*i* and 104-*j***.

The operation of the circuit of FIG. 1 is substantially similar to that described in U.S. Pat. No. 3,761,773 issued Sept. 25, 1973 to Johnson and Schmersal. Alternative drive circuitry for realizing the circuits shown in FIG. 1 is given, for example, in Dick, "Low Cost Drivers for Capacitively Coupled Gas Plasma Display Panels," Proc. of the S.I.D., Vol. 13, No. 1, First Quarter 1972, pp. 6–13, and in U.S. Pat. No. 3,689,912 issued to G. W. Dick on Sept. 5, 1972.

Figure 2:
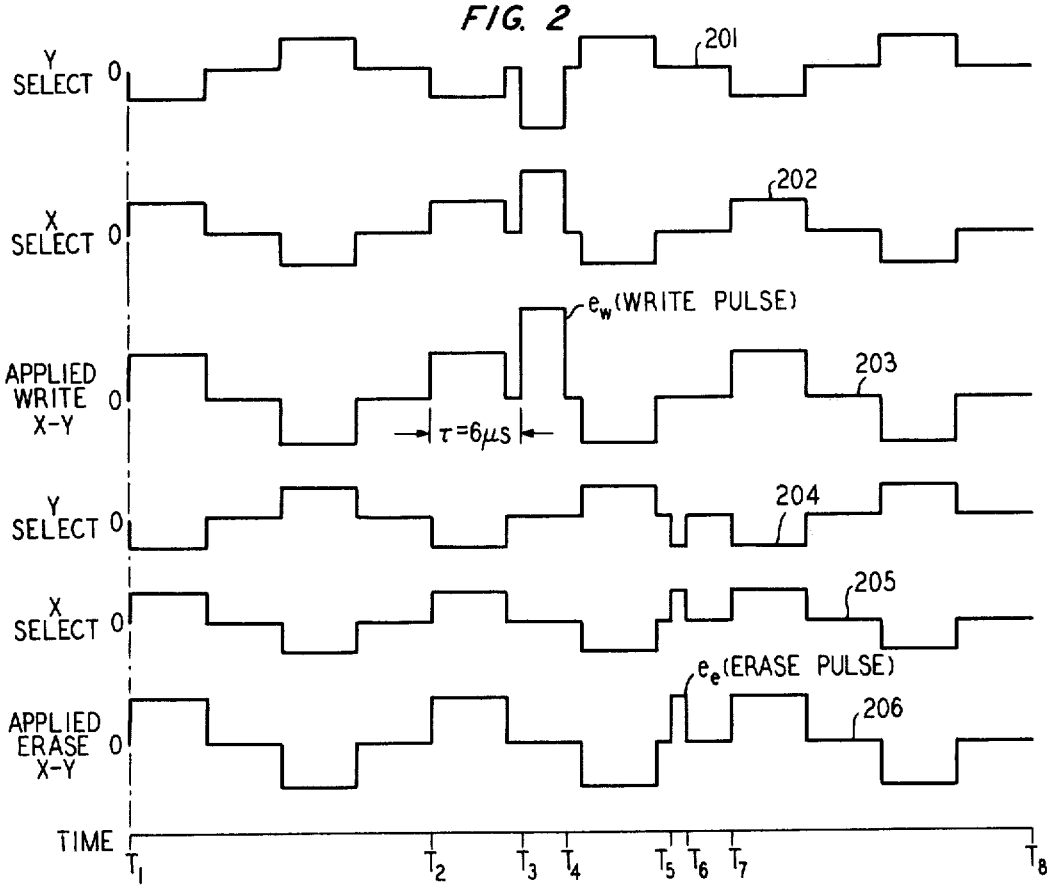
FIG. 2 shows typical pulse sequences, and combinations thereof, for the sustain pulse source 105 and the address circuit 110 in FIG. 1.

In FIG. 2, waveform 201 is representative of the Y select signal applied to a particular one of the column electrodes 104-j in FIG. 1. Similarly, waveform 202 is the waveform applied to a typical X or row electrode in FIG. 1. Waveforms 201 and 202 indicate the normal sustain sequence and, in addition, contain in the interval from $T_3$ to $T_4$ partial write signals. Waveform 203 represents the combined effect of the signals 201 and 202 as experienced by a particular selected plasma display cell. It should be understood that in typical sustain operation, e.g., from $T_1$ to $T_2$ or $T_7$ to $T_8$, no write or erase signals are present, so that "on" cells remain "on", and "off" cells remain "off". In the interval from $T_2$ to $T_7$, however, it is noted that the partial write signals occurring in the interval from $T_3$ to $T_4$ are additive, and are superimposed on the normal sustain waveform. The effect of this, of course, is to cause a breakdown at the selected cell which otherwise would not occur upon application of the sustain signal alone. After the interval $T_3$ to $T_4$ and upon the application of the normal sustain signal, e.g., that applied during the interval from $T_1$ to $T_2$, the selected cell will remain in the "on" condition.

Waveforms 204 to 206 show a typical operating pulse sequence to effect the erase of a particular cell, i.e., the extinction of an "on" cell. As is seen in the interval from $T_7$ to $T_8$ and $T_1$ to $T_2$, the normal sustain pulse sequence is applied to the selected cell. However, in the interval from $T_5$ to $T_6$ the partial erase pulses indicated as included in waveforms 204 and 205 combine to produce the waveform 206, thereby to effect an erase of the selected cell.

It should be understood, of course, that the designation X or Y for a particular coordinate direction or waveform is quite arbitrary; the roles for X and Y quantities may be interchanged as desired.

Figure 3:
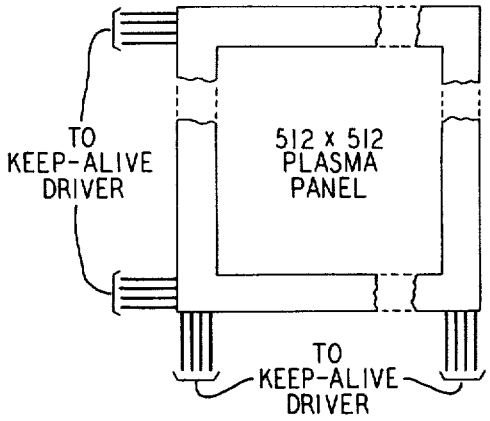
FIG. 3 shows the positions of keep-alive cells on a typical prior art plasma display panel.

FIG. 3 shows a prior art plasma panel typified by that described in the previously cited Johnson and Schmersal paper. In the representation in FIG. 3 only the four topmost and bottommost X electrode leads are shown explicitly. Similarly, only the four leftmost Y electrode leads and the four rightmost Y electrode leads are shown. The plasma cells defined by the leads shown in FIG. 3 and associated orthogonal electrode leads are the keep-alive cells previously mentioned. These keep-alive plasma cells therefore form a band, here 4 cells wide, around the entire panel.

As indicated in FIG. 3, the leads connected to the keep-alive cells are connected to keep-alive sustain signal sources (which comprise respective X and Y drivers substantially identical to those shown in FIG. 1 as 106-i and **107-*j*). Of course, since information will not be arbitrarily written in the keep-alive cells, i.e., they will be "on" at all times when the panel is in use, there need not be an address circuit of the usual kind. Instead, there is typically used a high-voltage source responsive to the initial turn-on of power for the display panel which drives the keep-alive plasma cells to their initial "on" condition. This special high-voltage signal is typically derived in standard fashion from circuits equivalent to the write address circuits shown in FIG. 1. After initial turn-on, drive circuits like those shown in FIG. 1 by the blocks 106-*i* and 107-*j*** maintain the keep-alive cells on the plasma panel in this "on" condition.

While the four rows and columns of cells defining the border of the plasma panel of FIG. 3 are illustratively chosen to be keep-alive cells, there may in other appropriate cases be a greater or lesser number of such keep-alive cells. Because the prior art keep-alive cells remain in the "on" condition whenever the panel is in use, no addressing is required of the drive circuits for these keep-alive cells. Further, since the need to avoid spurious ignition of the keep-alive cells does not exist, they are typically driven by separate sustain signal sources and associated drivers which may apply a somewhat higher voltage than the normal sustain drivers.

In operating the plasma panels of the type shown in FIGS. 1 and 3, e.g., a plasma panel with a 512 × 512 matrix of plasma cells, it has been found that the operating voltages required to accomplish a write operation vary considerably according to the distance of the selected cell from the keep-alive cells shown in FIG. 3. As mentioned previously, in Commercial panels it has been the custom to fix the delay, $\tau$, from the occurrence of the light pulse produced by the positive portion of the keep-alive sustain signal to the application of the write pulse at a single value, typically $\tau = 2.0\ \mu$ sec, for all cells (see FIG. 2); in the above-cited Ngo application, $\tau$ may vary from 0 to a $\tau_{max}$, typically in the vicinity of 6 $\mu$ sec.

Figure 4:
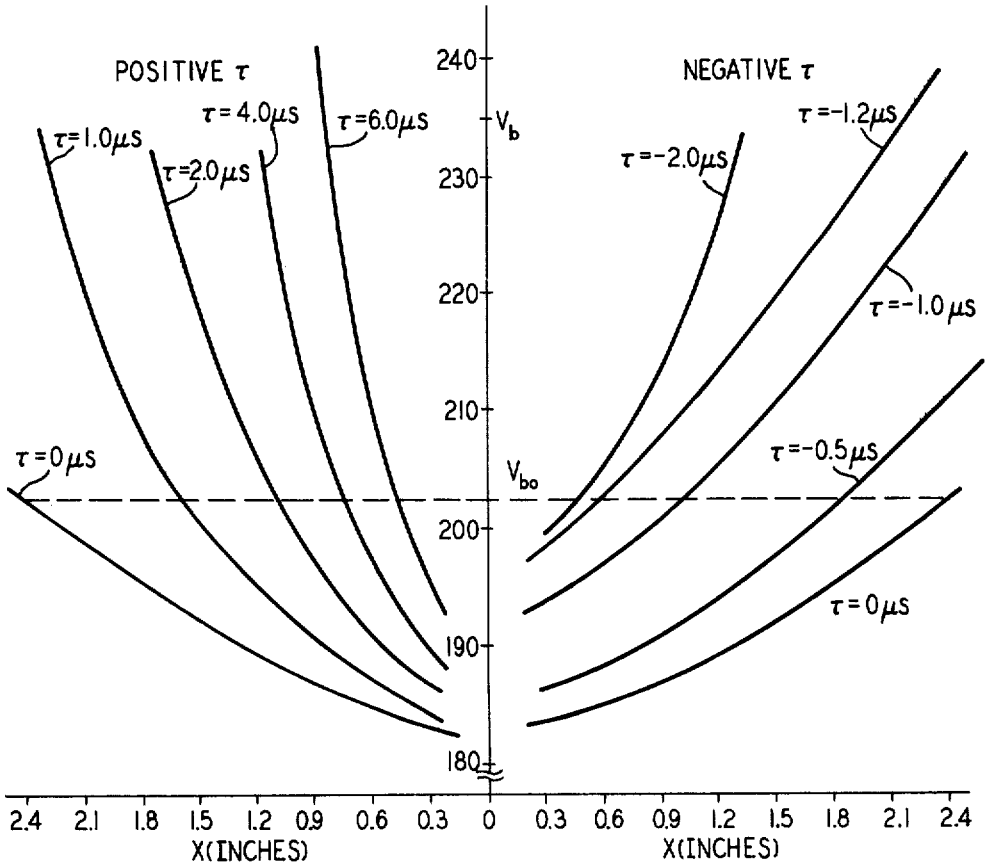
FIG. 4 shows typical breakdown voltages $V_b$ as functions of separation of a given cell from the keep-alive cells, for a variety of keep-alive cell light pulse times (relative to addressed cell write pulse times)

FIG. 4 shows the relationship between the breakdown voltage $V_b$ of a plasma cell as a function of the separation from the nearest band of border (row or column) keep-alive cells, each band typically being 4 cells wide. Thus, in the case $\tau = 2.0$ microseconds (positive $\tau$), it is seen that there is a variation between the cells closest to the keep-alive cells and those separated by 1.8 inches (approximately the center of a 4 × 4 inch panel) of approximately 16 percent. It should be apparent that this variation in the breakdown voltage for a number of spaced apart cells has the potential to give rise to crosstalk.

It can also readily be appreciated that crosstalk effects have been overcome in prior art systems only with a careful adjustment of all panel voltages within allowable margins. It can also be appreciated that panel-to-panel and cell-to-cell variations will create rather stringent margin contraints for operating voltages for production models of plasma panels of the type described. To minimize the susceptibility of panels to crosstalk effects, it has, therefore, been necessary in the prior art to impose rather strict tolerances on materials and manufacturing processes used to fabricate such panels. The production yield for panels of even modest size has, accordingly, been relatively low and the average fabrication cost high.

To correct the shortcomings of the prior art plasma panels with respect to the very narrow margins encountered in even moderate size plasma panels, the previously cited Ngo application provides means for selectively varying $\tau$ through a range of positive values. In FIG. 4 there is identified a point on the $\tau = 2.0\ \mu$ sec curve (corresponding to a typical commercial panel delay), a value for $V_b$ equal to $V_{bO}$. This voltage $V_{bO}$ is seen to be sufficient for a value of $\tau = 2.0$ microseconds to satisfactorily operate cells remote from the keep-alive cells by a distance of approximately 1.0 inches. Of course, any cells closer to the keep-alive cells than 1.0 inches will also satisfactorily operate with a value of $\tau = 2.0\ \mu$ sec and $V_b = V_{bO}$. If the voltage used to write a cell is maintained at $V_{bo}$ and the cell is located a distance, say 1.2 inches from the keep-alive cells, it is clear that the cell will not operate if $\tau$ is maintained at 2.0 microseconds. If, however, $\tau$ were to be modified to be equal to 1.0 $\mu$ sec, then for the given value $V_{bO}$, it is clear that the cell at $X = 1.2$ inches would be sufficiently stimulated to turn to the "on" condition. Similarly, if values of $\tau = 1.0\ \mu$ sec and 0 are chosen as shown in FIG. 4, it is clear that the voltage may again be maintained at $V_{bO}$ while writing into cells located at distances of 1.5 and 2.4 inches, respectively, from the keep-alive cells.

It should be clear that introducing a variability to $\tau$ not only makes it possible to use the lower voltage $V_{bo}$ for all cells, but also gives rise to wider operating margins for all cells in the array within the 1.8 inch interval.

However, it should also be noted that $\tau$ must be varied over a relatively wide range of positive values in order to permit operation at a uniform write voltage. The operating difficulties produced by these relatively large time lags will now be discussed.

As previously mentioned, the keep-alive sustain waveform in standard prior art panels was constructed by the superposition of the two half-select signals. One of the advantages of the dynamic keep-alive system is that only one of these half-select signals must be altered to produce the modified pulse. However, when displacements of as much as 6 $\mu$ sec are required, there will be a number of intermediate addresses for which the modified keep-alive pulse must be generated, at least in part, from a half-select pulse having the opposite polarity. This necessitates the generation of very complex waveforms in the other half-select signal. In order to produce these latter signals, the keep-alive drive circuitry must be quite complicated (in extreme cases a separate drive circuit may be required for each possible address), and will require a much higher voltage source. Generating these complex waveforms will also require the partial or complete cancellation of a number of wave pulses. Since no two pulses can be made identical enough to completely cancel, there will be residual voltage spikes which will interfere with the sustain process for the cell.

Furthermore, if extreme time lags are produced by stretching the keep-alive sustain signal, the voltage generated in one polarity will exceed the voltage generated in the other, creating cumulative charge imbalances which will eventually cause cross-talk. In some cases where the addressed cell is adjacent a number of "on" cells, it will be partially primed by its neighbors. In this case, the equalized priming afforded by the stretched sustain pulse is enhanced, increasing the probability of cross-talk. For cells located close to keep alive borders, (up to 0.30 inches from the border), the largest practical $\tau$, 6.0 $\mu$s, which still has some effect on the firing voltage, cannot bring the firing voltage to $V_{bO}$ level as shown in FIG. 4.

Returning briefly to FIG. 4 it will be noted that much smaller time lags are required to produce the same voltage variations when there is a negative $\tau$ relationship between the keep-alive sustain signal and the write signal. that is, when the address pulse precedes the keep-alive pulse by a given amount, the effect on required write or "firing" voltages across the panel is much more immediate than for the case where the keep-alive pulse precedes the address pulse by the same given amount. The firing voltage of cells located near the border keep-alive can be easily brought up to $V_{bo}$ level with proper value of negative $\tau$, $\tau = 2.0\ \mu$s. It is also noted for the above near border keep-alive region, a small range of negative $\tau$ can control a wider range of firing voltage. For convenience, the latter relationship shall be referred to as a "positive $\tau$," while "negative $\tau$" shall refer to the case where the address pulse precedes the keep-alive signals by an amount $\tau$.

The time lags required for the negative $\tau$ case are, in fact, so small, that none of the difficulties mentioned in connection with positive $\tau$ arise. And since the modified priming acts directly on the write pulse, effectively varying its duration, negative $\tau$ keep-alive operation also affords better control over operating margins. The present invention utilizes negative $\tau$ values to maximize the advantages afforded by the dynamic keep-alive principles.

As noted above, the write and erase pulses are typically synchronized with the normal (main array) sustain pulse sequence. Additionally, since the sustain drivers for the keep-alive cells may be derived at least in part from a separate signal source, it is preferable in many cases to vary $\tau$ by controlling the operation of the keep-alive drivers. That is, the most effective manner of changing the relative timing, $\tau$, between the keep-alive cell (sustain) firing and the main panel write (or other address) pulses proves to be the shifting of the keep-alive cell sustain pulses.

Figure 5:
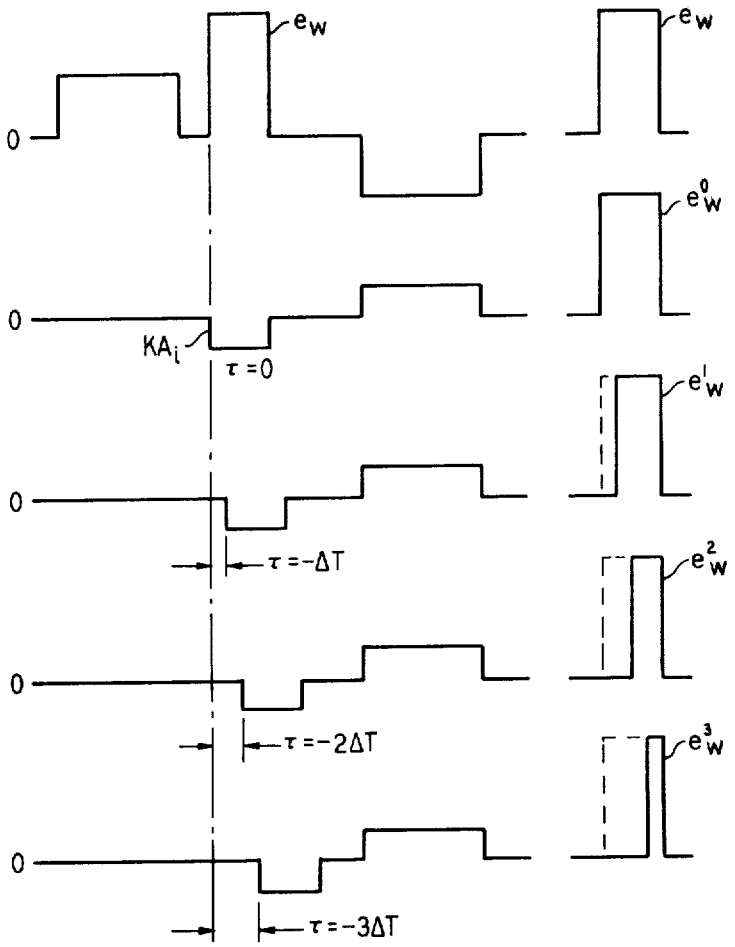
FIG. 5 shows typical modified timing for keep-alive cell sustain signals and the effective duration of the correlated write signals in accordance with one aspect of the present invention, the actual write pulse being shown in dotted lines.

In modifying the value of $\tau$ in the above manner, it has proven convenient to choose four values for $\tau$, viz., $\tau = 0, -\Delta T, -2\Delta T$, and $-3\Delta T$. Further, it has proven convenient in accordance with one embodiment of the present invention to achieve negative $\tau$ values by retarding the keep-alive sustain signal as indicated in FIG. 5. The top waveform represents a typical write (or other address) pulse, $e_W$, which is superimposed on the main panel sustain signal. The remaining four waveforms indicate the varying delays required of the sustain pulse for the keep-alive cells in an illustrative embodiment of the present invention.

The effective duration of the primed write pulse and the actual write pulse in dotted lines are shown parallel to each sustain pulse. Actually, as shown in FIG. 5, only that keep-alive sustain pulse occurring during the half cycle in which the address pulse occurs need be retarded. For convenience of explanation, the discharge resulting from a given keep-alive sustain pulse will be assumed for the present to occur simultaneously with the beginning of that pulse.

Figure 6:
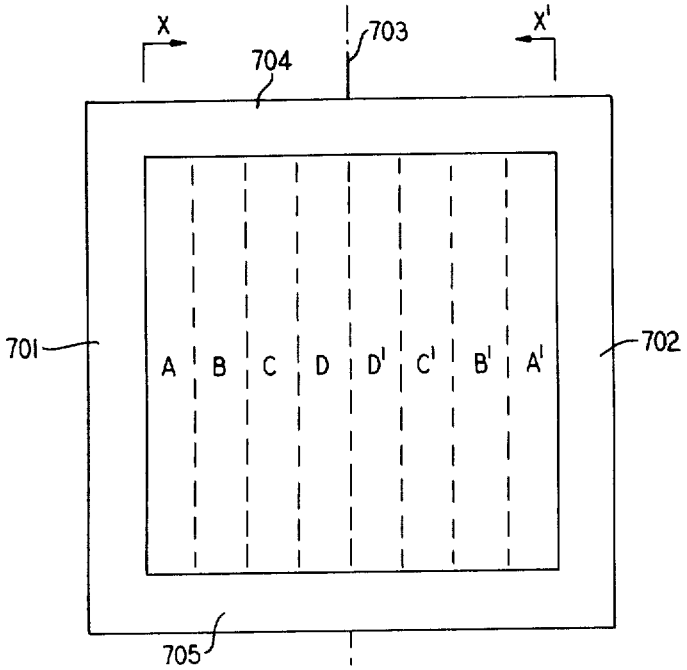
FIG. 6 illustrates a division of a plasma panel into useful bands of cells.

Each of the four values for $\tau$ shown in FIG. 5 is conveniently associated with a respective one of four segments in each half panel. The individual segments in a given pair of segments (one in each half panel) associated with a given value of $\tau$ are located symmetrically with respect to the panel center. That is, it proves convenient, for initial descriptive purposes, to divide a plasma panel of the type commercially available from Owens-Illinois into eight separate bands as shown in FIG. 6. The bands A, B, C, and D in FIG. 6 represent columns of cells successively more distant from the keep-alive cells maintained in an "on" condition along the left margin or edge 701. Specifically, they represent positions of increasing values for the coordinate X shown in FIG. 6.

Figure 7:
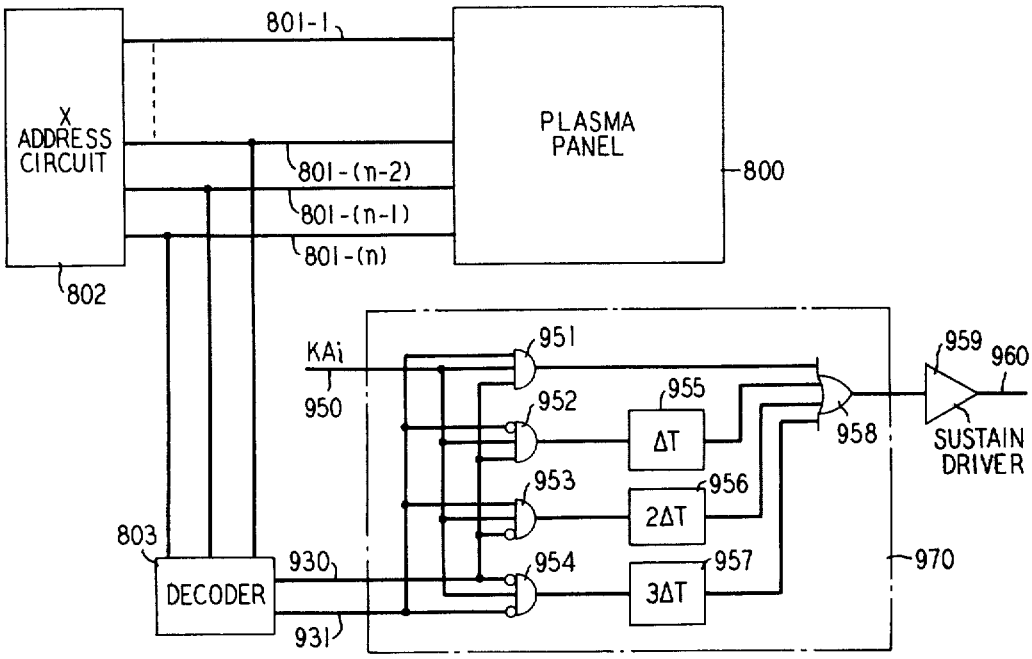
FIG. 7 illustrates one embodiment of circuitry for generating keep-alive sustain signals which are selectively spaced in time by an amount $\tau$ relative to a standard write pulse in response to address signals identifying one of the bands shown in FIG. 6.

Bands A', B', C', and D' are mirror image equivalents of the bands A, B, C, and D as reflected about the centerline 703. The A', B', C', and D' bands, of course, represent bands of cells whose X' coordinates are of increasing significance in the nomenclature of FIG. 6. Thus, it is clear that the cells in the C' band suffer from remoteness from the border keep-alive cells 702 to substantially the same degree as cells in the C band suffer from remoteness from keep-alive cells 701. The adverse effects of remoteness from keep-alive cells along borders 704 and 705, and means for correcting such effects, will be considered subsequently; it will be assumed, for present discussion purposes only, that there are to keep-alive cells along borders 704 and 705. no It should be readily apparent that for a 512 × 512 plasma panel, any particular cell can be addressed by two 9-bit binary words, one defining X position, and one defining Y position. Further, in the most obvious addressing scheme, measuring, cell location from the extreme left edge, i.e., X = 0 in FIG. 7, the most significant of the nine address bits will designate which half of the display panel (left or right) in FIG. 7 is to be accessed. Similarly, for a given value, say 0, for the most significant bit, the 2nd and 3rd most significant bits will determine which of the bands A, B, C or D will be selected. It should be clear that the symmetry relationship between bands A and A', B and B', C and C', and D and D' dictates that the 2nd and 3rd most significant bits also determine the band selected when the most significant bit is a 1, i.e., when the right half of the panel is addressed. Circuitry in accordance with one aspect of the present invention exploits these relationships in a manner to be described below.

FIG. 7 shows an overall organization for accomplishing the selective retardation of certain of the sustain pulses applied to the keep-alive cells as indicated in FIG. 5. In particular, there is shown in FIG. 7 a plasma display panel 800 to which are connected in standard fashion the plurality of addressing leads 801-*i*, $i = 1,2, \ldots, n$, emanating from the X select circuit 802. As indicated in FIG. 7, lead 801-1 is the least significant bit, and lead 801-*n* is the most significant bit. The signal on lead 801-n, then, indicates which half panel is selected. Correspondingly, leads 801-(*n*-1) and 801-(*n*-2) dictate the one of the four bands in the half panel in which a selected cell appears. At each addressing interval these band-indicating leads 801-(n-1) and 801-(n-2) apply their signals to a decoder 803.

Turning briefly to FIG. 5, we see a normal addressing pulse indicated as $e_w$. This pulse is assumed to be destined to establish an identified cell in the "on" condition, i.e., it is a write pulse. Beneath this is a control signal, $KA_i$ corresponding to a delayed version of the normal Y sustain waveform. Note that the negative portion of the waveform $KA_i$ commences at the onset of the address pulse. Thus in the terminology discussed above the waveform $KA_i$ represents the case where $\tau = 0$. It should be borne in mind, however, that the waveform $KA_i$ is not the high current sustain drive signal itself, but rather a control signal of corresponding waveform suitable for operating logic circuits.

In FIG. 5, $\tau$ is shown as the time between the onset of the write signal and the onset of the signal controlling the Y keep-alive sustain signal. This is a matter of convenience to explain the operation of the circuitry for varying $\tau$. Actually, it will be understood that this keep-alive sustain control signal $KA_i$ will commence slightly earlier than the beginning of the write pulse. This slight amount of time, $\delta$, is the time necessary to cause the keep-alive cell discharge to take place. The definition of $\tau$ given above, it will be recalled, refers to the spacing between the light pulse from the keep-alive cell (and, of course, the photoelectrons, etc.) and the occurrence of the write pulse. However, since the time $\delta$ is a constant, it merely lengthens $KA_i$ to commence $\delta$ seconds before the write pulse. For convenience only, the value of $\delta = 0$ will be assumed in the sequel unless otherwise noted.

Figures 9, 10:
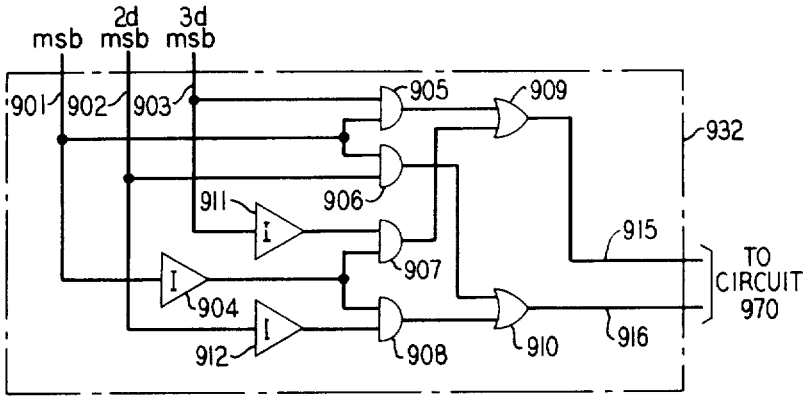
FIG. 9 shows modifications to the circuitry of FIG. 7 for extending the utility of the latter over the entire plasma panel.
FIG. 10 summarizes the relationship between the three most significant panel address bits and typical values for $\tau$.

Returning now to FIG. 7, we see that the address signals present in address circuit 802 are processed, or decoded, by a decoder 803 whose function is part of that of circuit 932 described in the discussion of FIG. 9 to generate signals specifying the required value for $\tau$. A standard logic level keep-alive sustain control signal, $KA_i$, having the waveform and relative spacing from the addressed cell write signal $e_w$ shown in FIG. 5, is applied to lead 950 in FIG. 7.

When a maximum value of $\tau = 0$ is indicated (a 11 bit pair on leads 930 and 931) AND-gate 951 permits the $KA_i$ signal on lead 950 to pass to keep-alive sustain driver 959 without additional delay. Since the signal on lead 950 is already positioned in time as indicated by the waveform $KA_i$ in FIG. 5 the required $\tau = 0$ value will be achieved. When a value of $\tau = -\Delta T$ is indicated by a 10 pattern on leads 930 and 931, AND-gate 952 is selected. This causes the $KA_i$ signal on lead 950 to be delayed in delay unit 955 by amount equal to $\Delta T$, but otherwise to remain the same. This causes the time spacing between the $KA_i$ signal and the leading edge of the $e_w$ signal to be increased by $\Delta T$. Thus the desired $\tau = -\Delta T$ value is achieved. Similar selection and delay operations are performed by gate 953, and corresponding delay unit 956 to achieve the $\tau = -2\Delta T$ value. The operation of the circuit of FIG. 7 is similar when a value of $\tau = -3\Delta T$ is indicated, or when no addressing is to occur is the same as in the typical unmodified commercial panels cited above.

Figure 8:
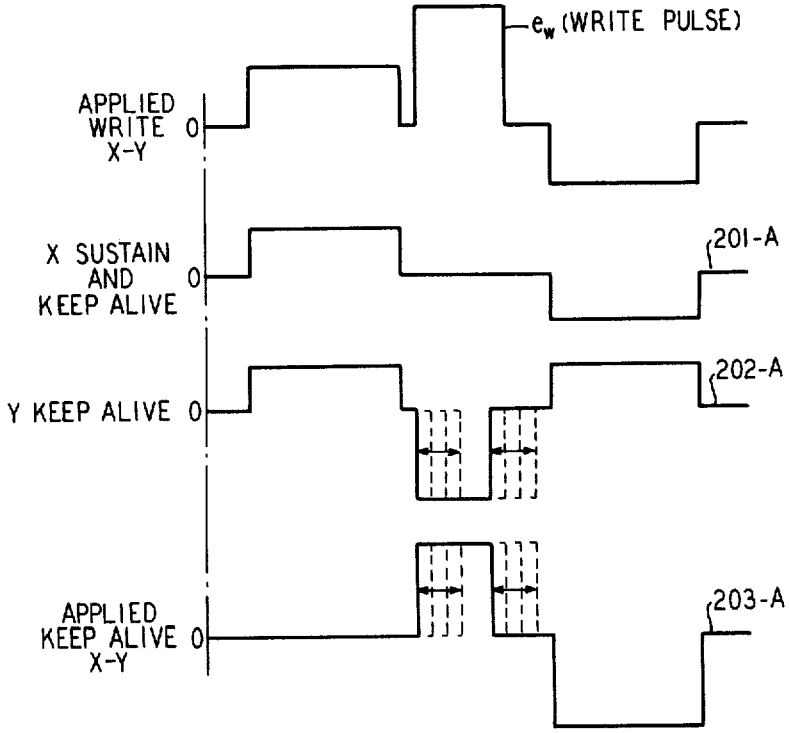
FIG. 8 shows the formation of a shifted sustain pulse based on the operation of the circuit of FIG. 7.

In the terminology of FIGS. 1, 2, and 3 the altered keep-alive sustain signals described above are Y sustain signals. That is, they are like waveform 201 in FIG. 2 except for the earlier or later time of occurrence of the negative pulse (for the particular cycle during which an addressing occurs), and the absence of any write signals superimposed thereon. Again it is noted that the keep-alive cell electrodes driven by the sustain driver 859 are those energized during the half cycle during which the address $e_w$ in FIG. 8 is superimposed on the normal sustain pulses supplied to the display (non-keep-alive) cells in the array. The sustain pulses supplied to the normal display cells need not be altered. Similarly, no alteration need be made to the sustain pulses supplied to the keep-alive cells during the half cycles when no address pulses are presented, i.e., in the terminology of FIG. 2, the X sustain pulses to the keep-alive cells need not be modified.

The effect of the circuitry of FIG. 7, then, is to generate one of the waveforms shown in FIG. 5, depending upon the address supplied by X select circuit 802 to the plasma panel 800. FIG. 8 shows the result of modifying a Y electrode sustain signal for $\tau = 0$, $\tau = -\Delta T$, $\tau = -2\Delta T$, and $\tau = -3\Delta T$ case. Waveform 201-A is based on that shown as 201 in FIG. 2. The first lower level pulse in waveform 201-A is identical to that normally occurring in waveform 201, but the second pulse begins late because of the operation of the circuitry of FIG. 8. In general, the inception time of this lower level pulse is variable, and is dependent on the address selected. This variability is indicated by the left-right arrows adjacent waveform 202-A in FIG. 8. When this variable-position pulse waveform is algebraically combined with a fixed-time X electrode sustain waveform, it produces the variable-position pulse waveform indicated by 203-A in FIG. 8. The broken lines indicate alternative pulse positions for waveforms 202-A and 203-A.

It should be clear that the arrangement described above in connection with FIG. 7 will be appropriate when the left half of the plasma panel shown in FIG. 6 is accessed. That is, the selection of the proper value of $\tau$ will be accomplished by processing the second and third most significant digit signals as described. When, however, an addressed cell is in the right half of a plasma panel like that shown in FIG. 6, it proves necessary to provide alternative means for controlling the decoder 803.

In particular, a signal indicative of the most significant digit in a desired address is applied on lead 901 to circuitry in accordance with FIG. 9. This most significant bit position signal is in addition to the second and third most significant bit signals applied on leads 902 and 903, respectively. The signal on lead 901 is, in turn, inverted by inverter circuit 904 to generate the complement of the most significant bit signal. Thus, depending on whether the most significant bit is a 1 or 0, one of the pairs of AND gates 905 and 906 or 907 and 908 will be selected.

AND-gate 906 supplies an unmodified version of the second-most-significant-bit signal (that on lead 902) to lead 916, by way of OR circuit 910 whenever the signal on lead 901 is a 1. When this latter signal is a 0, the signal on lead 902 is inverted by inverter circuit 912 and supplied to lead 916 by way of OR circuit 910. Similarly, either the signal on lead 903 or an inverted version of it is supplied to lead 915, according to whether the signal on lead 901 is a 1 or a 0. In effect, the circuit 932 in FIG. 10 functions as a special purpose address decoder.

Thus there are supplied on leads 915 and 916 the appropriate address-related signals designating bands on a panel as shown in FIG. 6 that reflect relative remoteness from the nearest row of keep-alive cells. The signals on leads 915 and 916 are, of course, those applied in parallel to decoder 803 in FIG. 7. FIG. 10 summarizes the possible bit patterns and the resulting values for $\tau$.

The above descriptions concerning values of $\tau$ and means for deriving them have, of course, been limited to the case where keep-alive cells are present only along two sides of a plasma panel. In the more usual case, e.g., that described in the above-cited paper by Johnson and Schmersal, the keep-alive cells are present around all four sides of the panel as shown in FIG. 3. The distance of a given cell on the panel matrix from sources of keep-alive photoelectrons, other ions and photons is therefore a function of both X and Y coordinates. Thus rather than considering only bands like those shown in FIG. 6, one profitably considers square areas as shown in FIG. 11.

Figure 11:
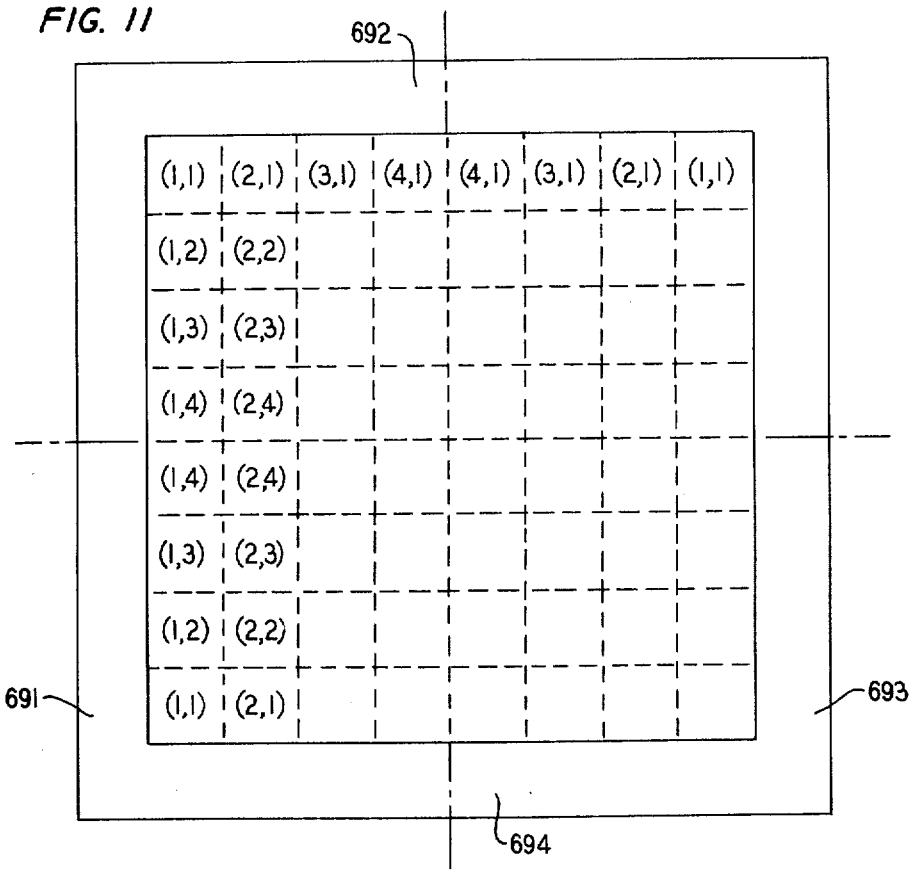
FIG. 11 illustrates an extension of the bands of FIG. 7 to two-dimensional segments.

In FIG. 11, a panel like that shown in FIG. 6 is shown divided into eight vertical and eight horizontal bands defining sixty-four squares. Each square may be identified by a two-couple $(i, j)$ indicating the distance $i$ from the nearest band of vertical keep-alive cells and a distance $j$ from the nearest band of horizontal keep-alive cells. Thus for example, the square designated (2, 3) is located two positions to the right of keep-alive band 691 and three positions below keep-alive band 692. The numbers $i$ are of course those derived from the first, second and third most significant bits of the X address coordinate of a given cell, and may be derived using circuitry like that shown in FIG. 9. The numbers $j$ are similarly derived by circuitry like that shown in FIG. 9, but based on the three most significant bits of the Y address.

There are, of course, many ways in which the values for $i$ and $j$ may be used to determine the appropriate value for $\tau$ in accordance with the goals and techniques described above. From a strictly geometric viewpoint, a composite value for $\tau$ proportional to $(i^2 + j^2)^{1/2}$ might be used. However, the additional computational complexity required to calculate $\tau$ on such a basis is not justified in most cases.

It has been determined that in a cell in a square like that designated (4, 1) at the top of FIG. 11 the keep-alive photon and photoelectron flux from the keep-alive cells along the left and right borders 691 and 693 has relatively little enhancing effect as compared to the flux from the keep-alive cells along the top border 692 in FIG. 11. In general, when keep-alive cells are located around the entire periphery, as in the panel described in the Johnson and Schmersal paper, supra, it proves convenient to ignore all but the closest set of border keep-alive cells in determining $\tau$. Thus while some contribution to enhanced main panel cell operation is made by all keep-alive cells, only the dominant contribution by the keep-alive cells nearest the addressed cell need be explicitly accounted for in setting $\tau$.

Figure 12:
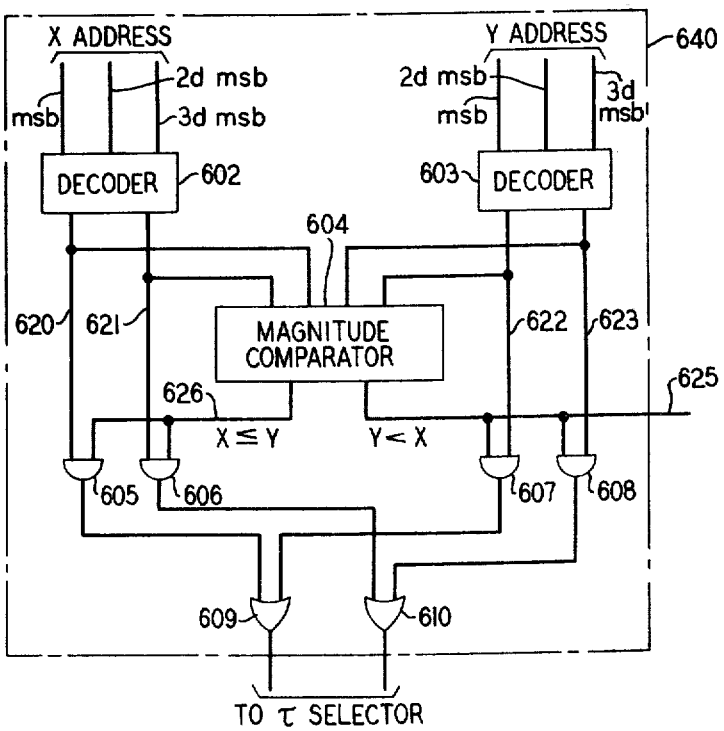
FIG. 12 shows circuitry for generating $\tau$-specifying signals for keep-alive cells located on either the horizontal or vertical borders of a plasma panel.

FIG. 12 illustrates circuitry for determining the appropriate value for $\tau$ when keep-alive cells are located along all sides. Again assuming that one of four possible values of $\tau$ will be selected, the problem reduces to one of comparing a function of the second and third most significant bits for the X and Y address of a cell to be addressed. As described previously in connection with the circuit of FIG. 9, a bit complementing is performed when a coordinate is identified by an address having a 1 as the most significant bit. Thus a pair of decoders like circuit 932 in FIG. 9 are used to derive the function of the second and third most significant bits which define the remoteness of a (horizontal or vertical) band of cells from the nearest parallel band of keep-alive cells. This pair of decoders includes circuits 602 and 603 in FIG. 12, corresponding to an X decoder and a Y decoder, respectively.

When decoders 602 and 603 have respective X and Y address bits applied to them, they generate on lead pairs 620 and 621, and 622 and 623 signals indicative of the distance from the relevant (nearest) border for each of the two coordinate directions. Comparator 604 then compares the bit patterns appearing on the lead pairs. If comparator 604 determines that the signals on leads 622 and 623 are lesser in magnitude (significance) than those on leads 620 and 621, a gating signal is generated on lead 625. This indicates that the cell selected is closer to a top or bottom edge of the panel than to a left or right edge.

If comparator 604 determines that the signals on leads 620 and 621 are lesser in magnitude than or equal to those on leads 622 and 623, then a gating signal is generated on lead 626. This indicates that the cell selected for addressing is closer to a left or right edge than to a top or bottom edge.

The signals generated on one of leads 625 or 626 allows the corresponding decoded signals on the associated address function lead pair to pass through AND gates 605 and 606 (for X-based signals), or AND gates 607 and 606 (for Y-based signals. The gated signals then pass by way of OR circuits 609 and 610 to a decoder like 703 in FIG. 8. Thus the appropriate address-related signals are used to control the gating of the sustain drivers for all of the keep-alive cells. As noted above, the dominant contribution to discharge enhancement will be made by the nearest band of keep-alive cells, though all others (with the same value for $\tau$) will contribute to some degree.

It will be appreciated from the foregoing that a significant relaxation of the present strict requirements for write signal levels may be achieved by using the present invention. Further, by easing one of the many critical and often conflicting constraints on plasma panel construction and operation, a greater tolerance for other non-optimum system parameters is achieved. Thus, for example, the uniformity of cell construction now required may be relaxed somewhat, thereby giving rise to higher manufacturing yields and lower overall cost. Because the criticality of write signals has been greatly reduced, less care need be taken in generating erase and sustain signals which would otherwise give rise to crosstalk problems.

While the more complete "coupling" between keep-alive and write signals has been emphasized in the preceding discussion, it is clear that an exactly equivalent coupling may be achieved between keep-alive and erase signals as well.

Further, such variable timing between the occurrence of other address signals, e.g., the scan pulse described in my copending application Ser. No. 345,893, filed March 29, 1973, now U.S. Pat. No. 3,851,327 issued on Nov. 26, 1974, and the keep-alive sustain signals will also be obvious in light of the present disclosure to those skilled in the art. Though only eight (or four in the case of horizontal-only or vertical-only keep-alive bands) different values for $\tau$ were used, any number of values for $\tau$ greater than one may be used. These values of $\tau$ may, of course, be assigned to an increased or decreased number of bands or squares in the sense of FIGS. 6 and 11. The values of $\Delta T$, may similarly be varied to accommodate panels of any particular size. The exact keep-alive waveforms are in no way critical to the use of the present invention.

While a simple selection of $\tau$ increments based on one of the X and Y addresses, as described above in connection with FIG. 12, has proven quite effective in coordinating write pulses and keep-alive cell operation, it is clear that more complicated linear or nonlinear functions of X and Y coordinates may prove advantageous in some cases. Such variations may be adopted for other than square panels, for example. That is, if the selection conductors should advantageously be relatively placed in a circular manner, e.g., positioned by polar coordinates r and $\theta$, and the keep-alive cells placed in a circular band, only the radial coordinate might be used to determine the value for $\tau$.

In appropriate cases, non-pulsed keep-alive sustain signals, e.g., sinusoidal signals, may be used with variable delay, i.e., phase, depending on the address of a location being written erased or otherwise accessed. Similarly, if all of the keep-alive cells are driven by both separate X and separate Y sustain circuits, many of the particular circuits described can be even further simplified.

While the typical structure used to illustrate the present invention has included a discharge panel utilizing the common spaced-apart conductor sandwich arrangement, other geometries including single-substrate constructions such as are illustrated in U.S. Pat. No. 3,646,384 issued Feb. 29, 1972 to Lay may profit from use of the present invention. Further, while uniform arrays of plasma display cells have been used as a vehicle for description, other more special purpose plasma devices may utilize the present invention. For example, cells in collections of cells defining letters or other characters, lines or other graphic entities may, either individually or collectively, be operated by conditioning signals having a time relation to addressing signals which are dependent on their position.

It should be clear, therefore, that the particular structure and operating sequences described above are merely typical. The central factor of variable time duration between conditioning signals, e.g., keep-alive light pulses and main panel addressing signals may be achieved in a variety of ways.

Further, while only plasma discharge devices have been described above, other devices which benefit from pre-conditioning signals derived from a more or less remote source will benefit from the application of the present invention. Similarly, while keep-alive plasma cells have been emphasized it should be clear that other sources of preconditioning flux used in prior art systems, e.g., pulsed ultra-violet light sources may also be operated in timed relation with the location of a location being addressed.

What is claimed is:

1. A display system comprising a plurality of display sites, each capable of existing in at least two states, circuit means for applying addressing signals to selected ones of said sites, at least one selectable external priming source disposed in an operative relation to said display sites for enhancing the effect of said addressing signals on said selected sites, and circuit means for selectively initiating the activation of at least said one priming source during a designated intermediate portion of an individual one of said addressing signals, said designated intermediate portion being determined by the position of a selected display site relative to the position of at least said one priming source.

2. The system of claim 1 wherein each of said display sites comprises a discharge cell, and each priming source comprises means for facilitating a discharge in a selected cell.

3. The system of claim 2 wherein each discharge cell comprises a plasma discharge cell, and each priming source comprises a plasma discharge cell maintained in a repetitively discharging mode of operation.

4. The system of claim 1 wherein said circuit means comprises means for generating activating signals substantially concurrent with said addressing signals, and means for selectively delaying said activating signals, thereby selectively modifying the effective duration of said addressing signals.

5. The system of claim 4 wherein said means for selectively delaying said activating signals comprises means for selectively delaying said activating signals by a smaller increment when said addressing signals are applied to sites more remotely spaced to identified priming sources, and for selectively delaying said activating signals by a larger increment when said addressing signals are applied to sites more closely spaced to identified priming sources.

6. Apparatus comprising an array of discharge cells, each comprising a volume of ionizable gas disposed between two or more uniquely associated conductors, addressing means for selectively applying addressing signals to said cells, at least one selectable external source of conditioning flux for priming said cells, and circuit means for selectively activating at least said one source at a time after the onset of the addressing signals which is dependent upon the distance of an addressed cell from at least said one source, thereby selectively modifying the effective duration of said addressing signals as a function of said distance.

7. Apparatus according to claim 6 wherein said conductors are arranged in mutually orthogonal sets along rows and columns of a matrix, said cells being defined by the overlapping of a particular orthogonal pair of said conductors, wherein each source is located in a fixed position relative to said matrix, and wherein said circuit means for selectively activating comprises circuit means for activating each source in accordance with the position of a selected cell in said matrix.

8. Apparatus according to claim 6 wherein each source comprises one of a plurality of keep-alive plasma cells, and wherein said circuit means for selectively activating comprises means for applying sustain signals to said keep-alive cells at a time dependent on the position of said selected cell relative to said keep-alive cells.

9. Apparatus according to claim 8 wherein said addressing means comprises first means for writing information into a selected cell, second means for erasing information from a selected cell, and third means for causing a selected cell to momentarily emit light.

10. Apparatus according to claim 8 wherein said conductors are arranged in mutually orthogonal sets along rows and columns of a matrix, wherein each source comprises one of a plurality of keep-alive plasma cells disposed around the periphery of said matrix, and wherein said circuit means for selectively activating comprises (1) means for determining the remoteness of a selected cell from the nearest edge of said matrix and (2) means for applying sustain signals to said keep-alive cells at a time dependent on said remoteness.

* * * * *